US007204348B2

(12) United States Patent
Bloch et al.

(10) Patent No.: US 7,204,348 B2
(45) Date of Patent: Apr. 17, 2007

(54) ASSEMBLY ARRANGEMENT OF A LIFT DRIVE IN A LIFT SHAFT

(75) Inventors: Hanspeter Bloch, Buchrain (CH); Mario Heggli, Lucerne (CH); Roland Delvento, Alponach Dorf (CH)

(73) Assignee: Inventio AG, Hergiswil (CH)

( * ) Notice: Subject to any disclaimer, the term of this patent is extended or adjusted under 35 U.S.C. 154(b) by 353 days.

(21) Appl. No.: 10/764,752
(22) Filed: Jan. 26, 2004

(65) Prior Publication Data

US 2004/0159501 A1 Aug. 19, 2004

Related U.S. Application Data

(63) Continuation of application No. PCT/CH02/00416, filed on Jul. 23, 2002.

(30) Foreign Application Priority Data

Jul. 26, 2001 (EP) ..... 01810740

(51) Int. Cl.
*B66B 7/02* (2006.01)

(52) U.S. Cl. ..... 187/406; 187/250; 187/254; 187/408; 248/346.05; 248/125.1; 248/125.2

(58) Field of Classification Search ..... 187/251, 187/254, 258, 361, 406, 408; 248/125.1, 248/125, 188.4, 207, 246.05; 74/841, 572
See application file for complete search history.

(56) References Cited

U.S. PATENT DOCUMENTS

| | | | | |
|---|---|---|---|---|
| 1,511,336 | A * | 10/1924 | Hoey | 248/656 |
| 3,631,960 | A * | 1/1972 | Sphul | 198/394 |
| 2002/0017434 | A1 * | 2/2002 | Orrman et al. | 187/254 |

FOREIGN PATENT DOCUMENTS

| | | |
|---|---|---|
| FR | 2 631 421 A | 11/1989 |
| JP | 60 106779 A | 6/1985 |
| WO | WO 99 43589 A | 9/1999 |
| WO | WO 00 15535 A | 3/2000 |

* cited by examiner

*Primary Examiner*—Eileen D. Lillis
*Assistant Examiner*—Stefan Kruer
(74) *Attorney, Agent, or Firm*—Schweitzer Cornman Gross & Bondell LLP

(57) ABSTRACT

An assembly arrangement for a lift construction supports the lift drive at the upper end of both a support column and lift cage and counterweight guide rails, allowing the lift drive load to be transferred to the floor of the lift by each of the supporting members. The support of the lift drive upon the rails may be accomplished through setting screws that allow the load applied to the rails to be adjusted.

4 Claims, 2 Drawing Sheets

ASSEMBLY ARRANGEMENT OF A LIFT DRIVE IN A LIFT SHAFT

This application is a continuation of PCT/CH02/00416 filed Jul. 23, 2002.

The present invention relates to an assembly arrangement of a lift drive in a lift shaft, wherein a support column is provided which extends through the lift shaft to the base of a shaft pit, and wherein a guide rail for a lift cage and a guide rail for a counterweight are arranged at the support column.

BACKGROUND OF THE INVENTION

In lift installations up to a certain conveying height the engine room can be omitted in the buildings concerned, and thus costs are saved and spaced gained. In the case of lift installations of that kind the lift drive, and in a given case, control equipment belonging thereto, therefore have to be arranged in the lift shaft.

A lift installation having a lift drive arranged in the lift shaft has become known by European Patent Application EP 0 849 209 A1. In that case two columns are provided which extend through the lift shaft to a shaft pit. A mounting plate, on which the lift drive is fastened, is provided at the upper end of one column. A lift cage is guided at guide rails which are retained at the columns by means of clamps in such a manner that they are functionally separate from the columns and the load of the lift drive is conducted into the shaft pit solely by way of the column supporting the mounting plate.

The present invention has the object of proposing an assembly arrangement by which a better load distribution can be achieved.

BRIEF DESCRIPTION OF THE INVENTION

The foregoing and other objects are fulfilled by an assembly of the present invention in which the lift drive is supported by both lift cage guide rails, which are mounted at the support column, and the support column, so that the load of the lift drive is supported on the base of the shaft pit not only by way of the guide rails, but also by way of the support column.

The advantages achieved by the invention are to be seen in that a better load distribution is achieved over conventional constructions and the compressive strength and bending resistance of the support construction are improved.

In a preferred embodiment the lift drive is supported on the guide rails by way of setting screws. Thus, compensation for tolerance between rails or columns of different length is possible in simple manner.

BRIEF DESCRIPTION OF THE DRAWINGS

The invention is explained in more detail in the following detailed description of an exemplary embodiment in conjunction with the drawing, in which.

DETAILED DESCRIPTION OF THE INVENTION

Figure 1:
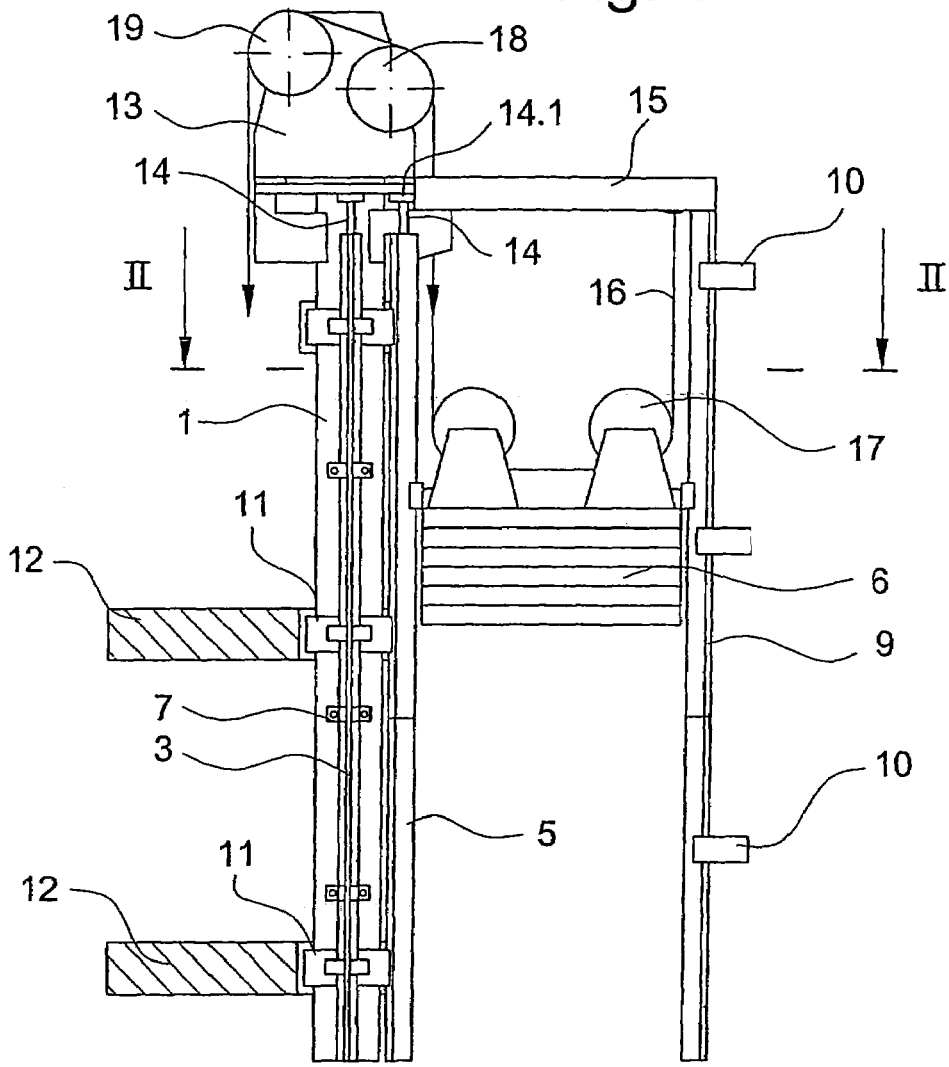
FIG. 1 is a partial elevation view of a lift installation with the assembly arrangement according to the invention.
Figure 2:
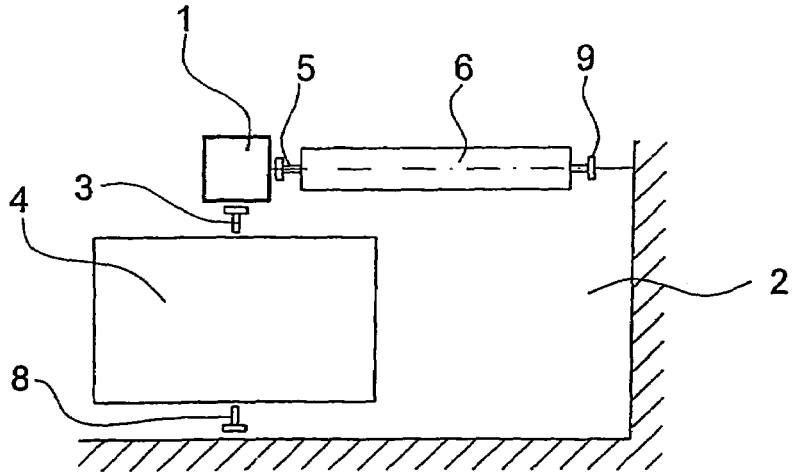
FIG. 2 is a simplified schematic section view taken along II—II in FIG. 1.
Figure 3:
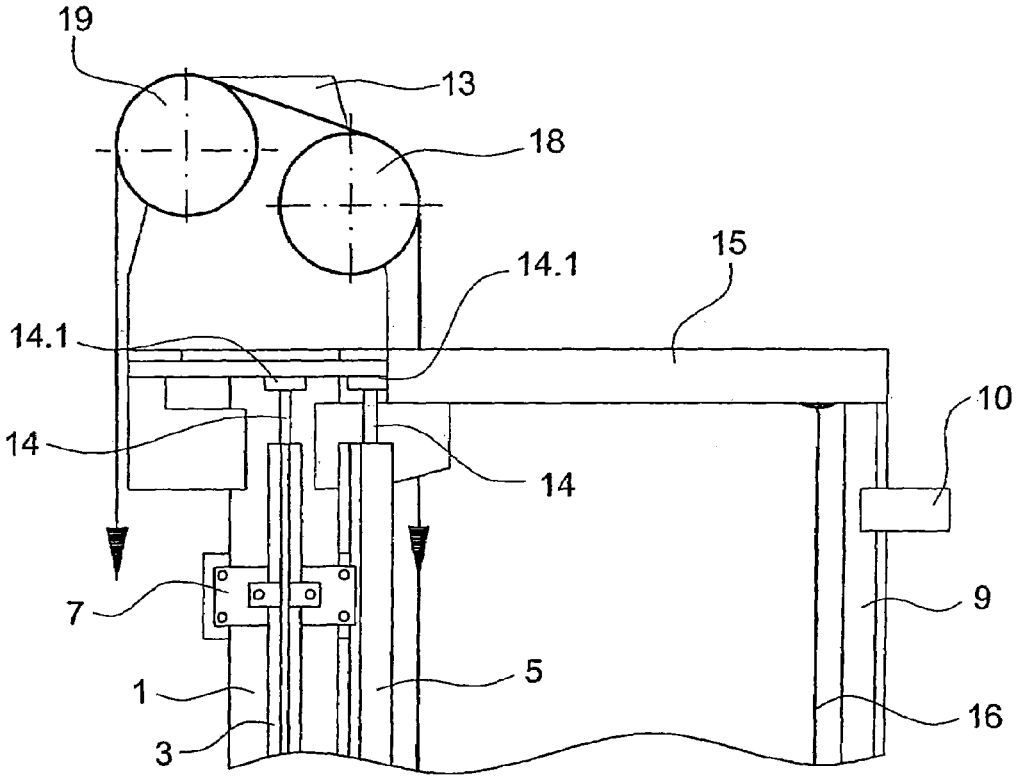
FIG. 3 is a view of the uppermost part of the lift installation according to FIG. 1, on an enlarged scale.

A support column, which extends through a lift shaft 2 to the base of a shaft pit (not further illustrated) and which consists of, for example, a square hollow profile member, is denoted by 1 in FIGS. 1 to 3. A guide rail 3 for a lift cage 4 and a guide rail 5 for a counterweight 6 are mounted at the support column 1 by means of clamps 7. Second guide rails 8, 9 for the lift cage 4 and the counterweight 6, respectively, are fastened by way of mounts 10 to the walls of the lift shaft 2. The guide rails 3, 5 at the support column 1 extend, like the support column 1, to the base of the shaft pit. The support column 1 is fastened to story floors 12 by means of further mounts 11.

Figure 3A:
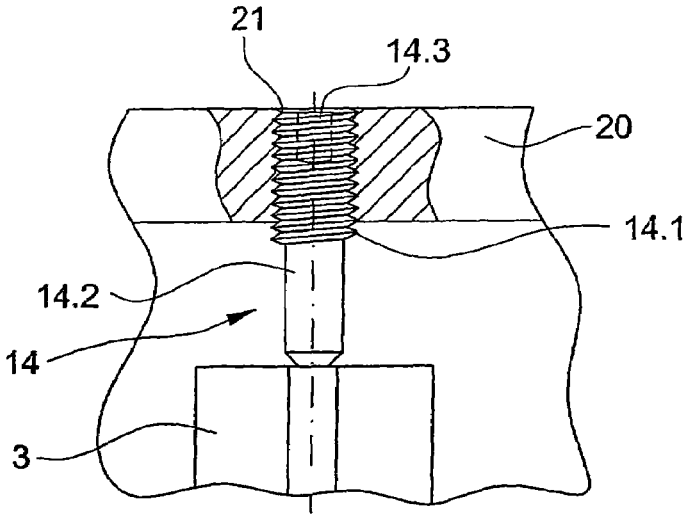
FIG. 3*a* is a detail view of a portion of a base plate for the lift drive with setting screws for the guide rails.

A lift drive 13 is mounted on a base plate 20 fastened to the upper end of the support column 1. This base plate has, in a region overlying the associated guide rails 3 and/or 5, threaded holes 21 for reception of setting screws 14. Thus, the base plate can be additionally supported on the guide rails 3, 5 by way of setting screws 14 so that the vertical loads acting on the lift drive 13 are transmitted to the base of the shaft pit not only by way of the support column 1, but also by way of the guide rails 3, 5. In FIG. 3*a* there is illustrated, on an enlarged scale, how one of the setting screws 14 is seated by its threaded part 14.1 in the internal thread of the threaded hole 21 and is supported by its shank 14.2 on the guide rail 3. By turning the setting screws 14 with the help of a hexagonal socket 14.3 thereof the load transmitted by the setting screws to the guide rail 3 can be adjusted in a simple manner at the assembly location of the lift. Instead of a hexagonal socket, the shank 14.2 of the setting screw 14 can have an external square or external hexagon portion to be actuated by an open-end wrench. The engagement surfaces for the wrench lie at the end of the setting screw, so that a longest possible setting travel is achieved.

A cross member 15 is supported at one end on the second guide rail 9 for the counterweight 6 and at the other end at the lift drive 13. Conveying cables 16 are fastened to the cross member 15 and lead to the lift cage 4 by way of deflecting rollers 17, which are mounted at the counterweight 6, a diverting roller 18 and a drive pulley 19 of the lift drive 13.

We claim:

1. An assembly arrangement of a lift drive in a lift shaft, wherein a support column is provided which extends through the lift shaft to a base of a shaft pit, and wherein a guide rail for a lift cage and a guide rail for a counterweight are arranged at the support column, characterized in that the guide rails extend through the lift shaft to the base of the shaft pit and that the lift drive is supported on the guide rails by way of at least one setting screw bearing against at least one guide rail and on the support column so that a load of the lift drive is transmitted to the base of the shaft pit by way of the guide rails and the support column.

2. The assembly arrangement according to claim 1, further characterized in that the lift drive is mounted on a base plate which has a region overlying the guide rails and at least one threaded hole in the region for mounting of the at least one setting screw.

3. The assembly arrangement according to claim 1 or 2, further characterized in the setting screws are chosen from the group comprising headless screws having a either a top hexagonal drive recess or a hexagonal shank portion adjacent the guide rails.

4. The assembly arrangement according to claim 1, further characterized in that the support column comprises a square hollow profile member.

* * * * *